United States Patent [19]

Toomey et al.

[11] Patent Number: 4,718,182

[45] Date of Patent: Jan. 12, 1988

[54] TRENCHER WITH ADJUSTABLE CHISEL

[75] Inventors: Jeffery M. Toomey, Shelley Beach; John J. Toomey, Maroochydore, both of Australia

[73] Assignee: Sausar Holdings Pty. Limited, Australia

[21] Appl. No.: 855,429

[22] Filed: Apr. 24, 1986

[30] Foreign Application Priority Data

Apr. 24, 1985 [AU] Australia ..... PH0278

[51] Int. Cl.[4] ..... E02F 5/02

[52] U.S. Cl. ..... 37/98; 172/699

[58] Field of Search ..... 37/98, 99, 193; 172/699, 700

[56] References Cited

U.S. PATENT DOCUMENTS

| | | | |
|---|---|---|---|
| 74,327 | 2/1868 | Everdon | 172/699 |
| 935,288 | 9/1909 | Witter | 37/98 |
| 3,041,751 | 7/1962 | Chattin | 37/98 |
| 3,550,691 | 12/1970 | Davies et al. | 172/699 |
| 3,565,182 | 2/1971 | Teasdale | 172/699 X |

*Primary Examiner*—Clifford D. Crowder

*Attorney, Agent, or Firm*—Stevens, Davis, Miller & Mosher

[57] ABSTRACT

A trench digging device (1) for attachment to the three point linkages of a tractor, comprising a frame (2), a downwardly and forwardly directed elongate chisel (3) mounted for longitudinal movement with respect to the frame (2), chisel adjustment means connected with the frame (2) and the chisel (3) to adjustably position the chisel (3) relative to the frame (2), and spoil displacement means (4) mounted to the frame (2) to move spoil displaced from a trench by the chisel (3) away from the trench.

6 Claims, 4 Drawing Figures

TRENCHER WITH ADJUSTABLE CHISEL

BACKGROUND OF THE INVENTION

1. Field of the Invention

The present invention relates to devices for forming elongate trenches such as are used for drainage purposes.

2. Description of the Prior Art

Previously known devices function in one of a number of ways.

A first type of device, broadly described as a back hoe, operates in the manner of a mechanical shovel and progressively excavates a trench by repeated scooping actions.

While such devices are suitable for forming a trench in confined areas and on uneven terrain, they include a considerable number of components which are exposed to a harsh operating environment. The resulting wear requires frequent replacement of the components.

Additionally, since their mode of operation requires the repetitive performance of a number of manually controlled, disjointed steps, the speed at which a back hoe can be operated is determined primarily by the skill of the operator.

A second type of device forms a trench by advancing a continuously cycling plurality of cutting and scooping elements through the ground. The elements may be mounted on a chain or wheel.

While this type of device is suitable for use by a relatively unskilled operator, it includes an inordinate number of moving parts which, like those of the back hoe, are subject to considerable wear. Additionally, these devices are generally inflexible with regard to the width of trench which they are capable of forming.

The complexity of such devices also precludes the inclusion of reasonably priced control systems, which would enable them to operate at an optimum speed having regard to the power of their driving motor and the power necessary to form the trench in any particular type of ground.

It is an object of the present invention to provide a trench forming device able to overcome or at least ameliorate the above mentioned shortcomings of the prior art.

SUMMARY OF THE INVENTION

The present invention consists in a trench digging device comprising a frame adapted to be drawn, a downwardly and forwardly directed elongate chisel mounted for longitudinal movement with respect to said frame, chisel adjustment means connected with said frame and said chisel to adjustably position said chisel relative to said frame, and spoil displacement means mounted to said frame to move spoil displaced from a trench by said chisel away from said trench.

BRIEF DESCRIPTION OF THE DRAWINGS

A preferred embodiment of the present invention will now be described, by way of example only, with reference to the accompanying drawings in which.

DESCRIPTION OF THE PREFERRED EMBODIMENT

Figure 1:
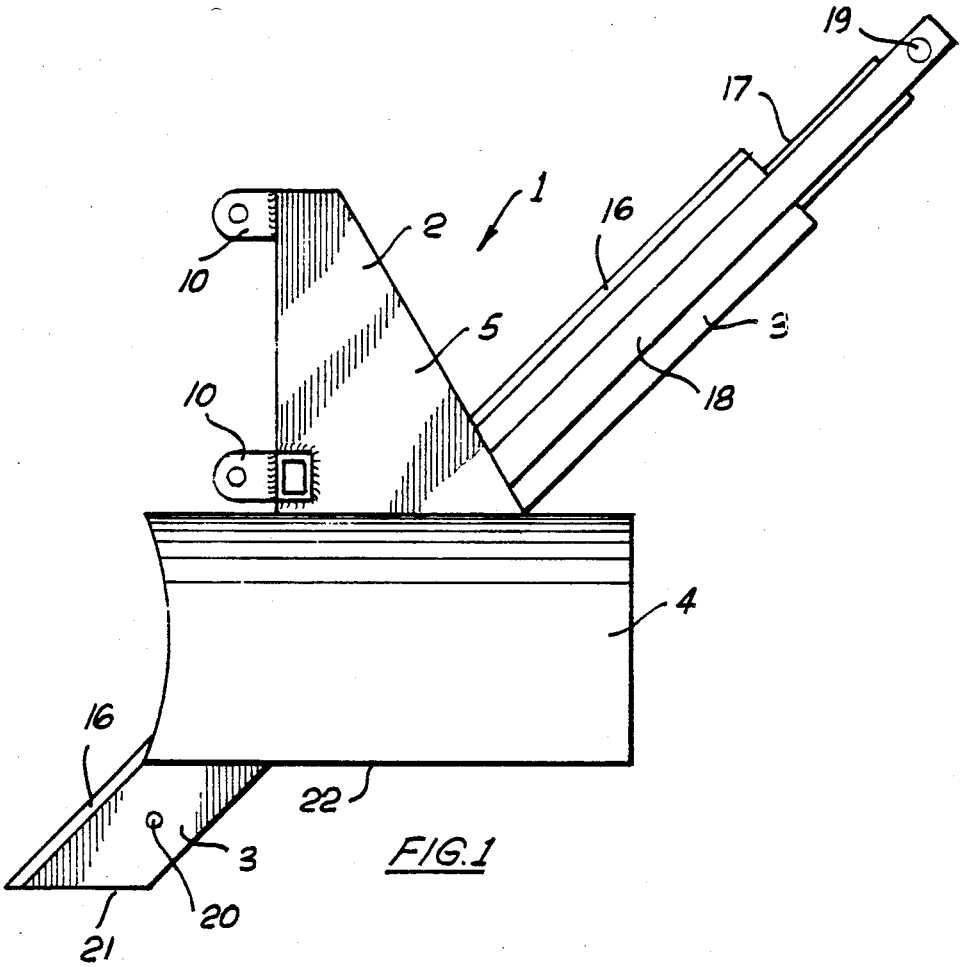
FIG. 1 is a side elevation of a trench digging device according to the invention.
Figures 2, 4:
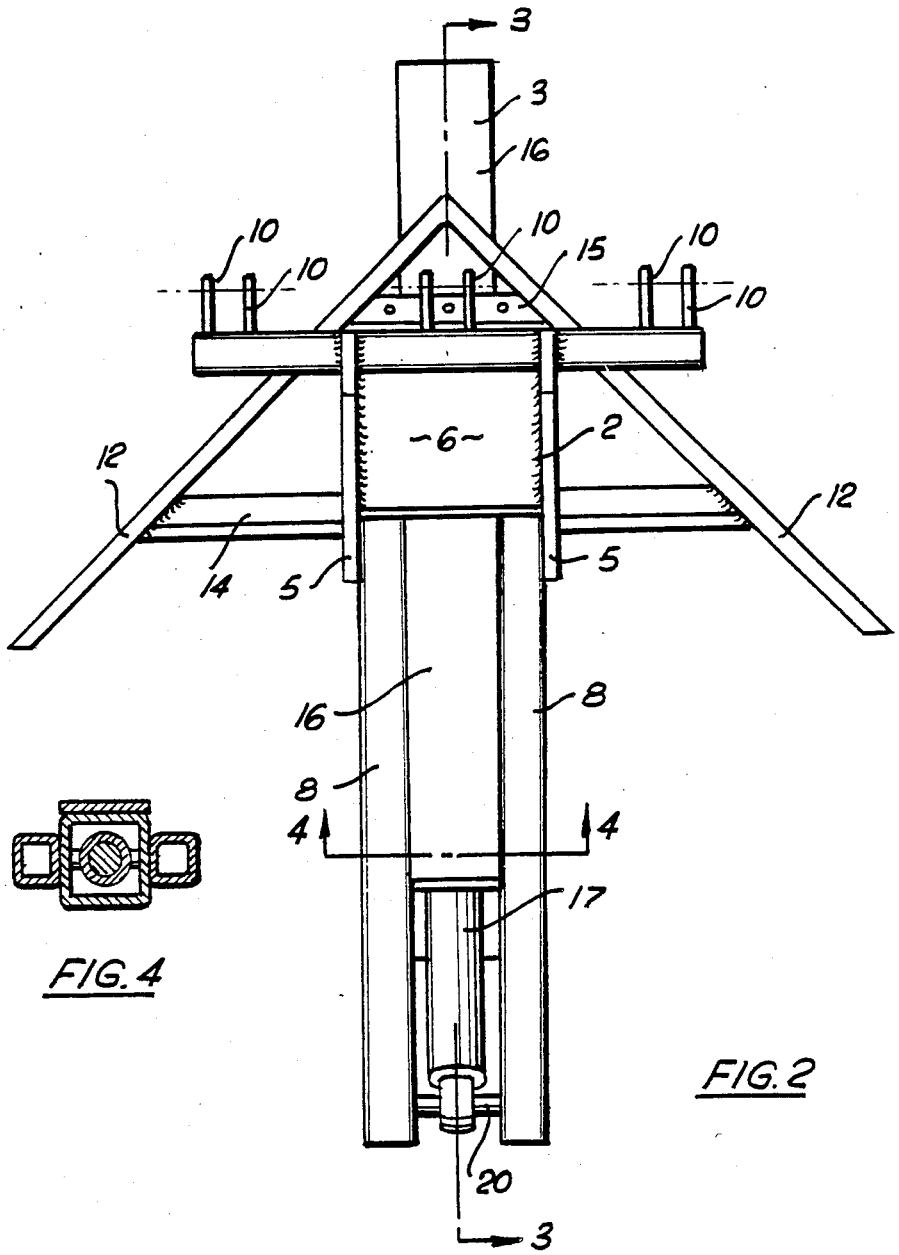
FIG. 2 is a plan view of the device of FIG. 1.
FIG. 4 is a section taken on line 4—4 of FIG. 2.
Figure 3:
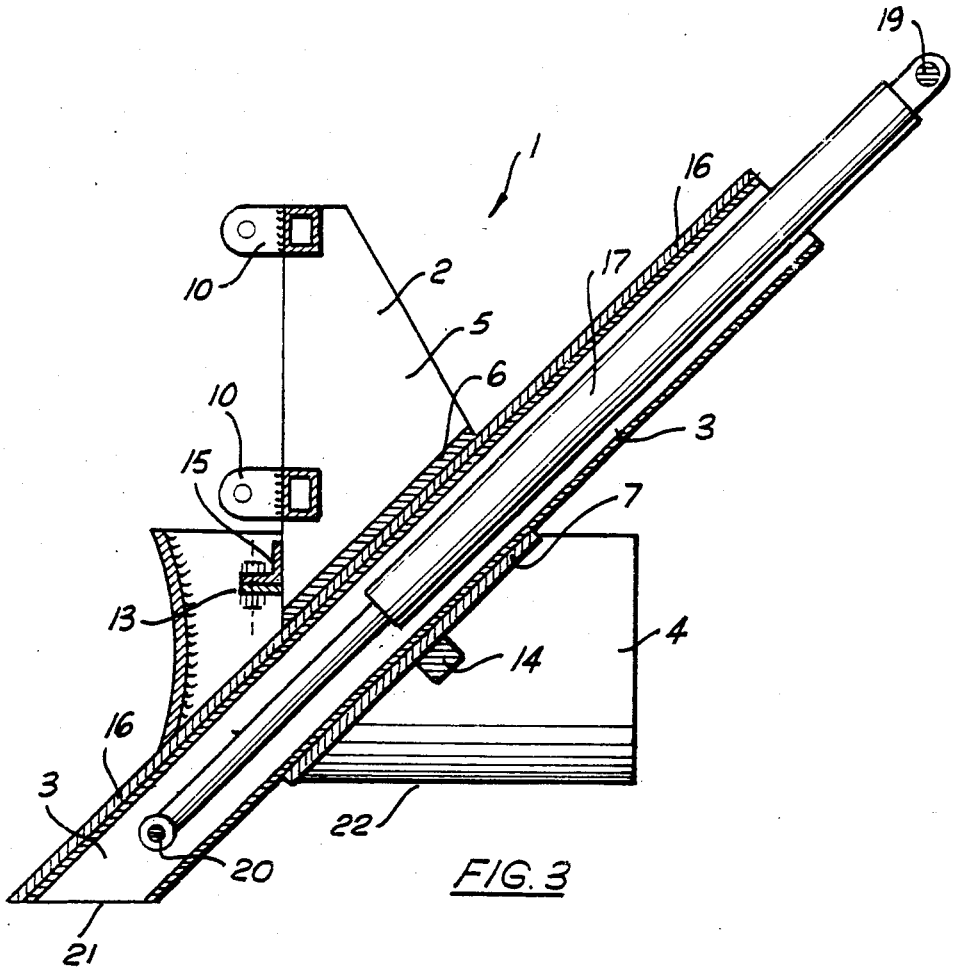
FIG. 3 is a section taken on line 3—3 of FIG. 2.

Referring to the drawings, the trench digging device indicated generally at 1 comprises a frame 2, a downwardly and forwardly directed elongate chisel 3 adjustably mounted to the frame 2 for longitudinal sliding movement relative thereto and spoil displacement means 4 also mounted to the frame 2.

The frame 2 comprises two vertically extending parallel spaced-apart triangular plates 5, and two parallel spaced apart guide plates extending between the triangular plates 5 in the form of an upper guide plate 6 and a lower guide plate 7.

The perpendicular distance between the guide plates 6 and 7 is sufficient to enable the chisel 3 to slide between them.

The frame 2 further includes a pair of parallel spaced apart support bars 8, each of which is fixedly attached to a respective one of the mutually facing sides of the triangular plates 5 to guide and support the chisel. The support bars 8, in conjunction with the guide plates 6 and 7 define a channel through which the chisel 3 may slide. The frame 2 also includes attachment brackets 10 to enable the device 1 to be connected to the three point linkages of a tractor.

The spoil displacement means 4 comprises a pair of forwardly and outwardly directed blades 12 which meet at an apex located in front of the frame 2. The blades 12 are mounted to the frame by a forward mounting plate 13 and a rear mounting bar 14. The plate 13 is bolted to a bracket 15 on the frame and the bar 14 is bolted to the lower guide plate 7. The spoil displacement means is thus securely attached to the frame 2 with its apex directed forwardly.

In the preferred embodiment the chisel 3 comprises a length of hollow steel tube having a wear plate 16 releasably attached along its upper side. The tube may be circular or of any suitable section but is preferably square.

The wear plate 16 may be replaced when it becomes excessively worn. It can also be interchanged with wear plates of differing widths as may be required. The wear plate is attached to the tube by an array of bolts. However, it may be attached by any suitable means such as by being keyed to the tube or it may be formed integrally with the tube.

An hydraulic ram 17 constitutes the chisel adjustment means. One end of the hydraulic ram 17 is hingedly mounted between the distal ends 18 of the support bars 8 by pin 19. The other end of the hydraulic ram 17 is connected to the lower end of the chisel 3 by a further pin 20 extending between opposed sides of the chisel. It will be appreciated that a substantial portion of the hydraulic ram 17 is housed within the chisel itself.

The hydraulic ram 17 is supplied with operating fluid by hoses (not shown) which extend from the distal ends of the support bars 8 for connection to a suitable hydraulic power source, for example, a tractor.

The blades 12 are provided with a passage at their apex through which the chisel may project to a preselected extent upon actuation of the hydraulic ram 17.

In operation, the trench digging device 1 is attached to a tractor by attaching the tractor's three point linkages to respective attachment brackets 10. The device is thus able to be raised and lowered upon those linkages in conventional manner.

Initially, the hydraulic ram 17 is retracted to its maximum to thereby retract the chisel 3 so that its lower end 21 is level with the lower edges 22 of the blades 12. The three point linkage is then lowered until the lower edges 22 of the blades 12 scrape the ground into which a trench is to be formed. The hydraulic ram 17 is then extended to project the lower end of the chisel 3 downwardly and forwardly into the ground through the passage in the apex of the blades. The extent of this projection is dependent upon a number of factors including the power of the tractor, the available traction and the hardness of the ground. The device is then hauled by the tractor so that the chisel scores a trench in the ground. The spoil displacement blades 12 direct progessively excavated spoil down their length and away from the trench, thereby preventing the spoil from spilling back into the newly formed trench.

If a deeper trench is required than that which can be formed by a single pass, the tractor may be turned around and the chisel re-positioned in the trench for a second pass. The hydraulic ram is then further advanced so as to extend the chisel further into the ground. The device is then hauled back along the partially formed trench to increase its depth. It will be appreciated that if a trench is required of considerable depth or in hard ground a plurality of passes may be required.

If the required width of the trench is greater than that of the chisel 3, the wear plate 16 may be replaced by a wear plate of greater width. The frame plates 5 are sufficiently spaced to accommodate a wear plate of greater width than the tube. It will be appreciated that the lower ends of the support bars 8 act to prevent lateral movement of the chisel 3 irrespective of the width of the ware plate 16.

In the preferred embodiment, the chisel is forwardly and downwardly inclined at an angle of 45° degrees to the horizontal. However, the chisel may be inclinded at any suitable angle, preferably between 70° and 20°.

It will be appreciated that the housing of the hydraulic ram 17 within a square hollow chisel is particularly advantageous since the hydraulic ram can be relatively short in relation to the extension length of the chisel. Additionally, it is protected during its operation.

It will be appreciated that while the illustrated device is adapted to be hauled by tractor or similar prime mover, a self powered device or a device moved by any suitable means will fall within the scope of the present invention.

It will further be appreciated that while the illustrated device includes blades, any means for preventing spoil from falling back into the formed trench may be used, such as a conveyor belt, archimedean screw arrangement or any other suitable means.

It will also be appreciated that any means may be used for advancing the chisel through the passage in the blades, such as a lead screw.

The device may also include a guide means for use on a second or subsequent traversement so as to align the device with a partially formed trench. The linkage between the device and the tractor may also include an articulated portion to accommodate some minor misalignment of the tractor with pre-formed trench.

We claim:

1. A trench digging device comprising a frame to be drawn, a downwardly and forwardly directed elongate chisel mounted for longitudinal movement with respect to said frame, chisel adjustment means connected with said frame and said chisel to adjustably position said chisel relative to said frame, and spoil displacement means fixed to said frame to move spoil displaced from a trench by said chisel away from said trench, said spoil displacement means comprising a pair of forwardly and sidewardly directed blades meeting at an apex, each blade having a lower edge adapted to contact the ground into which a trench is being formed, said blades having an aperture through said apex at the lower edge of said blades sized and configured to receive said chisel, said chisel being configured such that operation of said chisel adjustment means is effective to vary the extent of downward and forward projection of said chisel in relation to said blades from a retracted position at which the lower extremity of the chisel is substantially level with the lower edge of the blades of the displacement means to selectively extended positions at which the lower extremity of said chisel is positioned below and in front of said lower edge, in which extended positions, in operation, the chisel has means to cut both the bottom and sides of the trench.

2. A trench digging device according to claim 1 wherein said frame includes attachment means enabling said device to be releasably connected to the three-point linkages of a tractor.

3. A trench digging device according to claim 1 wherein said chisel adjustment means comprises an hydraulic ram which extends between said frame and said chisel.

4. A trench digging device according to claim 3, wherein said chisel includes a length of hollow tube and wherein said hydraulic ram is substantially housed within said tube.

5. A trench digging device according to claim 4 wherein said chisel includes a wear plate which is attached to the upper side of said tube.

6. A trench digging according to claim 5 wherein said wear plate is releasably attached to said tube.

* * * * *